US005593373A

United States Patent [19]

Hale

[11] Patent Number: 5,593,373

[45] Date of Patent: Jan. 14, 1997

[54] ECONOMICAL FOOT CONNECTED STILT ASSEMBLY

[76] Inventor: Russell S. Hale, 5174 Bristol St., Arvada, Colo. 80002

[21] Appl. No.: 399,918

[22] Filed: Mar. 7, 1995

[51] Int. Cl.[6] ..... A63B 25/00

[52] U.S. Cl. ..... 482/75; 623/28

[58] Field of Search ..... 482/76, 75, 148, 482/124, 77, 121, 126; 623/28, 32, 37, 47, 49, 52

[56] References Cited

U.S. PATENT DOCUMENTS

| | | | |
|---|---|---|---|
| 1,575,847 | 3/1926 | King et al. | 623/28 |
| 2,810,213 | 10/1957 | Jonas | 623/28 |
| 3,021,137 | 2/1962 | Palmer et al. | 482/147 |
| 3,441,272 | 4/1969 | Mann . | |
| 3,454,965 | 7/1969 | Kenworthy | 623/28 |
| 3,595,339 | 7/1971 | Ballard | 182/230 |
| 3,626,519 | 12/1971 | Baker | 623/28 |
| 3,626,609 | 12/1971 | Cramer | 623/28 |
| 3,660,920 | 5/1972 | Spina | 40/606 |
| 3,673,615 | 7/1972 | Ellis | 623/28 |
| 3,782,720 | 1/1974 | Thorson | 482/76 |
| 3,831,937 | 8/1974 | Jones | 482/76 |
| 3,994,467 | 11/1976 | Pike | 248/548 |
| 4,058,119 | 11/1977 | Rosequist | 623/28 |
| 4,569,516 | 2/1986 | Masterson | 623/28 |
| 5,074,548 | 12/1991 | Sawyer | 482/76 |
| 5,181,583 | 1/1993 | Platt | 182/189 |
| 5,295,932 | 3/1994 | Rowan | 482/76 |

*Primary Examiner*—Stephen R. Crow
*Attorney, Agent, or Firm*—Phillip A. Rein

[57] ABSTRACT

An economical foot connected stilt assembly comprising a pair of foot support base assemblies which are readily and releasably attached to a support structure being an elevating object such as an empty bucket, paint container, and other numerous types of material conveyance containers normally 5-gallon containers. Each foot support base assembly includes a support base member of a generally circular shape having an outer base inner ridge adapted to fit within a cooperating ridge or rim adjacent a bottom wall of the elevating object which will preferably be an inverted bucket member. The foot support base assembly is further provided with cooperating base attachment strap slots; toe strap slots; and heel strap slots, each operable to receive an attachment strap connected thereto, such as respectively attachment straps, a toe strap, and a heel strap. The attachment straps are for connection to the elevating object. Each support base member is operable to be readily connected through strap attachment hooks secured to respective outer ends of the attachment straps to an outer rim about an entrance opening of the elevating object. Each attachment strap includes an adjustable attachment buckle to provide secure attachment to the respective elevating object. Each support base member has a foot depression operable to receive a person's foot, shoe, or boot therein being anchored to the user's foot by a toe strap and a heel strap to provide a rigid attachment to the person's foot.

20 Claims, 1 Drawing Sheet

ECONOMICAL FOOT CONNECTED STILT ASSEMBLY

BACKGROUND

1. Field of Invention

This invention relates to stilts used for such applications as professional or do-it-yourself improvement construction work and recreation, specifically to an apparatus that allows the user to create stilts out of various common objects such as utility buckets.

While painting, drywalling, texturing, wallpapering, and doing other such common types of construction activities, much of the work must be done at a level above the worker's reach which creates many construction and repair activities that are attempted to be solved by elevating support stilt members.

Over the years, several ways have been devised to elevate workers to work on surfaces unreachable from the floor or the ground. The problem has been to develop equipment that:

a) allows easy horizontal and backwards movement, b) is height-adjustable, c) leaves the hands free for work, d) provides stability even on rough surfaces, e) is light-weight, f) fastens securely to the user, and g) is reasonably convenient to mount and dismount Since all of these goals cannot be ideally achieved in the same piece of equipment, tradeoffs are necessary. Furthermore, each of these goals must be weighed against cost as many of the potential users of such equipment are home-improvement do-it-yourselfers who will not spend up to $300 for a pair of elevating stilts of the type commonly used by professionals.

2. Description of Prior Art

The following United States patents are noted:

| U.S. Pat. No. | Inventor |
|---|---|
| 3,441,272 | Mann |
| 3,454,965 | Kenworthy |
| 3,626,519 | Baker |
| 3,660,920 | Spina |
| 3,673,615 | Ellis |
| 3,782,720 | Thorson |
| 3,831,937 | Jones |
| 3,994,467 | Pike |
| 4,569,516 | Wallboard Tool, Inc. |
| 5,074,548 | Sawyer |
| 5,181,583 | Platt |
| 5,295,932 | Rowan |

Stilts such as those described in U.S. Pat. Nos. 3,626,519 to Baker (1971), 3,441,272 to Mann (1969), 3,660,920 to Spina (1972), and 3,454,965 to Kenworthy (1966) are basically an extension of the lower leg, with some attempt to duplicate the flexibility and stability of the human foot. The first three kinds of stilts, designed to be used by professionals for applications such as sheetrocking, retail at prices between $200 and $300, beyond the means of a nonprofessional. The fourth kind of stilts is intended as toy adjustable stilts for children, rather than construction work whether professional or nonprofessional. Because surface area on the ground is small for all the aforementioned prior art, stability is limited, so that a user is at risk for falling while using the stilts. Consequently, the user must spend a great deal of time practicing walking in them. The number of parts comprising these stilts invites malfunctions and structural defects. Furthermore, in the versions by Baker and Spina, the number of leg and foot fastenings makes attaching and removing the stilts awkward and time-consuming—a major problem for the user who drops a tool white working, or has to get additional material to finish a job. These two versions also fasten to the leg by an extension arm, greatly increasing the risk of severe leg injury if the user falls. The stilts by Mann, on the other hand, do not leave the user's hands free for working.

A design of toy stilts for children, U.S. Pat. No. 3,782,720 to Thorson (1974) has even less area contacting the ground, and, like Mann's, requires the use of hands.

The nearest example of prior art, U.S. Pat. No. 5,181,583 to Platt (1993), although cheaper, less complicated and more stable than some construction workers' stilts, is not evenly stable in all directions. It has no heel control (it appears that stepping backwards or sideways would be difficult); it would probably still be rather expensive for the home-improvement do-it-yourselfer; and even when folded it is rather large for storage. Furthermore, it is fixed at one height.

PREFERRED EMBODIMENT OF THE INVENTION

In one preferred embodiment of the invention, an economical foot connected stilt assembly is provided including a pair of foot support base assemblies. Each foot support base assembly is operable to be releasably connected to a user person's foot and an elevating object.

Each foot support base assembly includes a support base member of a circular shape having a foot depression to receive a person's foot normally with a shoe or boot thereon and formed at an outer peripheral edge with a base inner ridge integral with a base bottom surface. The foot support base assembly includes a) the support base member; b) pairs of aligned base attachment strap slots or channels in the support base member with each pair operable to receive an attachment strap connected to an adjustable attachment buckle therethrough; e) an elevated heel plate having opposed heel strap slots operable to receive a heel strap therethrough for releasably attachment around a user's ankle area; and d) adjacent facing toe strap slots or channels operable to receive a toe strap therethrough for attachment over a top portion of a user's foot.

Outer ends of each of the attachment straps are connected to an outer entrance rim about an entrance opening into the elevating object.

The elevating object is preferably a 5-gallon material supply bucket having an outer bottom surface to receive the base bottom surface thereagainst and restricted against lateral movement by contact of the base inner ridge with a bucket's bottom edge rim.

The strap attachment hooks are placed about the outer entrance rim at the entrance opening into the elevating object. Next, the respective adjustable attachment buckles are operable in a conventional manner to secure the support base member against the elevating object.

Finally, the toe straps and the heel straps are used for connection of the respective support base members to a respective one of the user's feet in an obvious manner.

OBJECTS OF THE INVENTION

Accordingly, several objects and advantages of the economical foot connected stilt assembly of this invention are:

a) to provide an apparatus that attaches the user's foot to an elevating object (such as, but not restricted to, a utility bucket, pail, canister, can, or other container or vessel), the height of which is determined by the user (for instance, by attaching the apparatus to a stack of two or more utility buckets);

b) to provide an apparatus that, when not attached to an elevating object, is small enough so that the user who uses the apparatus only on occasion can store it conveniently when not in use;

c) to provide an apparatus to create stirs that give the user a stable working platform by distributing the user's weight over an area large enough for stability, yet not so large the user's feet are abnormally far apart;

d) to provide an apparatus to create stirs the user can move easily from place to place without the use of hands, leaving the user's hands free for work;

e) to provide an apparatus with simple but secure toe and heel attachments, that can easily be fastened and unfastened, enabling the user to climb on and off the stilts easily on such occasions as when a tool is dropped or more work material is needed;

f) to provide an apparatus that, by allowing the user to make stirs from such common items as a utility bucket (for instance, a 5-gallon bucket used as a bulk container for various common household supplies such as laundry detergent, animal food, paint, construction materials, etc.), keeps the stilts within the price range of a home-improvement do-it-yourselfer;

g) to provide an apparatus used to make stilts that require no special knowledge or skills to make or use;

h) to provide an apparatus used to make stilts simple enough to require little or no maintenance;

i) to provide an apparatus that does not require a potentially injurious leg attachment for stability;

j) to provide an apparatus that can accommodate various foot sizes without having to adjust the foot base;

k) to provide an apparatus to create stilts that allow the user, while elevated, to move forward, backward, or side-to-side, with ease and stability;

l) to provide an apparatus used to make stilts that can be used as a seat when not in use;

m) to provide an apparatus of few parts that require little assembly;

n) to provide an apparatus used to make stilts appropriate to varied surfaces;

o) to provide an apparatus used to make stilts with no moving pars;

p) to provide an apparatus used to make stilts that can be used on either foot;

q) to provide an apparatus which does not require the use of special footwear; and r) to provide an apparatus used to make stilts that effectively re-use and recycle waste containers.

Further objects and advantages of the economical foot connected stilt assembly will become apparent from a consideration of the drawings and ensuing description.

Various other objects, advantages, and features of the invention will become apparent to those skilled in the art from the following discussion, taken in conjunction with the accompanying drawings in which:

FIGURES OF THE INVENTION

Figure 1:
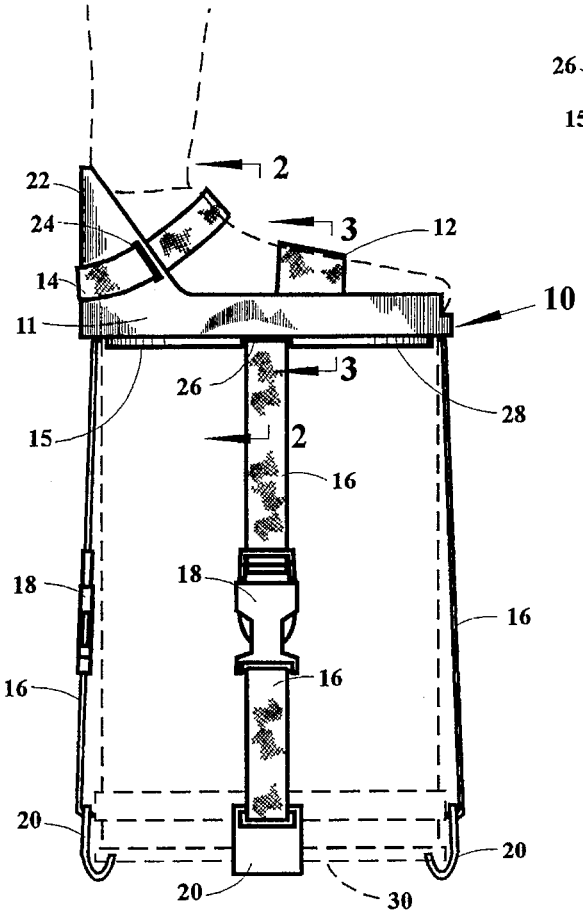
FIG. 1 is a side elevational view of an economical foot connected stilt assembly when attached to an elevating object.

REFERENCE NUMERALS IN DRAWINGS 10 foot support base assembly
11 support base member
12 toe strap
14 heel strap
15 base bottom surface
16 attachment strap
18 adjustable attachment buckle
20 strap attachment hook
22 heel plate
24 heel strap slot
26 base attachment strap slot
28 a base inner ridge
30 elevating object
32 toe strap slot
34 foot depression
36 non-skid texturing The following is a discussion and description of preferred specific embodiments of the economical foot connected stilt assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

A typical embodiment of the economical foot connected stilt assembly of this invention which consists of two (2) foot support base assemblies 10 (one for each person's foot and support stilts made from it are collectively shown in FIGS. 1, 2, 3, and 4.

Figure 2:
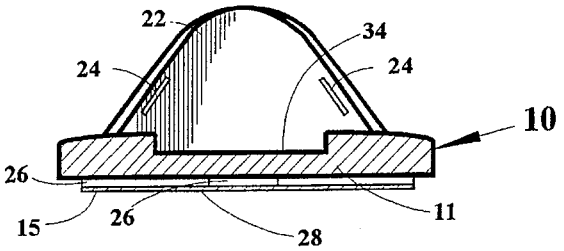
FIG. 2 is a fragmentary sectional view taken along line 2—2 in FIG. 1.
Figure 3:
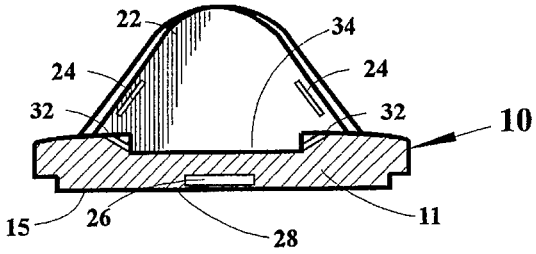
FIG. 3 is a fragmentary sectional view taken along line 3—3 in FIG. 1.

FIG. 1 shows a side view of the foot support base assembly 10 secured to an elevating object 30. Each foot support base assembly 10 includes a circular support base member 11 which is formed out of rigid material, such as, but not limited to, plastic, wood, metal, carbon fiber, etc. A base inner ridge 28 surrounding a base bottom surface 15 is formed onto the bottom of the support base member 11 and fits closely inside a bottom edge of the elevating object 30 (in the preferred embodiment, a utility bucket). (Please note that FIG. 3 shows the ridge 28 with respect to the support base member 11.) Four base attachment strap slots or channels 26) pairs opposed and aligned with each other) penetrate the base inner ridge 28 (as shown in FIG. 2 and FIG. 3).

Two attachment straps 16 fit respectively into the respective pair of the attachment strap slots 26, passing through the base inner ridge 28 perpendicular to each other, crossing each other (but not attached to each other) underneath a center of the support base member 11. The attachment straps 16 fasten the support base member 11 onto the elevating object 30. The attachment straps 16 each having one adjustable attachment buckle 18 (a plastic buckle, in the preferred embodiment). Both ends of both straps have a strap attachment hook 20 that secures the attachment straps 16 to the elevating object 30. Each hook 20 is a small J-shaped slotted piece that fits securely on a top rim of the elevating object 30.

Figure 4:
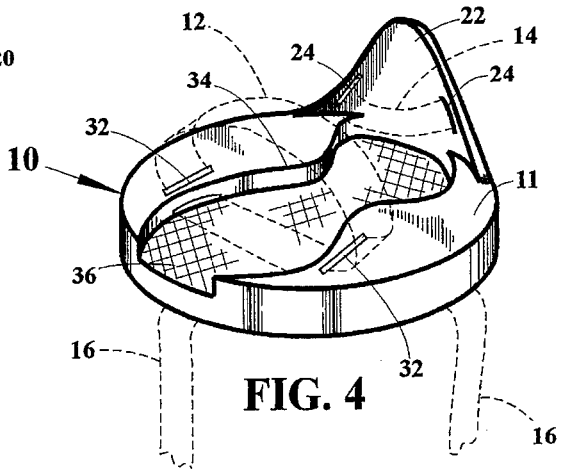
FIG. 4 is a perspective view of a foot support base assembly of the economical foot connected stilt assembly of this invention with connector straps illustrated in dotted lines.

FIG. 4 is a perspective view from above of the support base member 11. Each support base member 11 has a shoe-shaped foot depression 34 (also shown in FIGS. 2 and 3) with non-skid texturing 36 to improve stability. A toe strap 12 laces through the support base member 11 via two toe strap slots 32 on either side of the depression 34. The toe strap 12 fastens itself over the user's foot, by a hook and loop fastener in the preferred embodiment. On the back end of the support base member 11, a heel plate 22 is formed, centered on the foot depression 34. The heel plate 22 makes an acute angle (much like a ski boot heel) with the support base member 11, for optimal heel support. The heel plate 22 has two heel strap slots 24 on either side, A heel strap 14 laces through the heel strap slots 24 in the heel plate 22. The heel strap 14 fastens to itself over the user's foot, by a hook and loop fastener in the preferred embodiment.

USE AND OPERATION OF THE INVENTION

In order to build a support stilt from the support base assembly 10, the user finds an elevating object 30 of a height needed and wide enough for stability, such as a utility bucket (as in the preferred embodiment). The user inverts the bucket, being the elevated object 30, and places the support base member 11 fight side up on the bottom wall of the elevating object 30 so that the base inner ridge 28 is settled within the bucket's bottom edge rim. The slip hooks 20 are placed around the bucket's top rim (making sure that a bucket handle is secured up against the side of the elevating object 30 under at least one attachment strap 16). If necessary, the user extends or shortens the attachment straps 16 by adjusting them at the adjustable attachment buckles 18. To make a taller, shorter, wider, or narrower support stilt, the user may find a different size/height bucket or stack several buckets together or find any other elevating object 30 that a) is rigid enough to bear the user's weight, b) has one flat end, and c) has some protrusion that strap attachment hooks 20 can grip, on the opposite end.

On fastening the support stir or the foot support base assembly 10 to a user's foot with the elevating object 30 secured thereto and with the toe strap 12 and the heel strap 14 are loosened, the user's foot slips into the depression 34 against the heel plate 22. The user then tightens and fastens the toe strap 12 and the heel strap 14 as desired.

On unfastening the support stilt or the foot support base assembly 10 with the elevating object 30 attached from the user's foot, the user unfastens and loosens the toe strap 12 and the heel strap 14. The user's foot may then be removed from the foot depression 34 in the support base member 11.

In order to take the foot support base assembly 10 apart from the elevating object 30, the user unbuckles the adjustable attachment buckles 18. The user then unhooks the hooks 20, removes the support base member 11 from the utility bucket or elevating object 30, and refastens the adjustable attachment buckles 18 for storage.

The economical foot connected stilt assembly will provide a simple, stable, easily adjustable device enabling an average person to create a stable elevated platform or support stilts to work from, with little effort or expense.

While my above description contains may specificities, these should not be construed as limitations on the scope of the foot support base assembly 10, but rather as an exemplification of one preferred embodiment thereof. Many other variations are possible. For example, the toe strap 12 and the heel strap 14 could be attached with a buckle or other fastening device, and similarly, the adjustable attachment buckles 18 on the attachment straps 16 could be hook-and-loop fastener or another convenient adjustment device. Any strapping material (as well as fasteners and hooks attached to the attachment strap 16) could be made wider or narrower, or made of tougher or lighter material to suit conditions of heavy wear or other special applications. Likewise, strap and base color may vary. The strap attachment hooks 20 may be made of plastic or any other material that will hold up to wear of constant contact with the ground. The support base member 11 may be made of wood, metal, other plastics, or any other substance rigid enough to support the weight of a person. Handles or eyelets of metal, plastic, or other rigid material could substitute for the toe strap slots 32 and file heel strap slots 24 to make holes through which to lace file toe strap 12 and the heel strap 14. Another possible embodiment of the foot support base assembly 10 is in toy stilts for children, in which case the support base member 11 would be smaller in proportion to a child's foot and might be constructed to fit a 1-gallon coffee or paint can. Accordingly, the scope of the foot support base assembly 10 should be determined not by the embodiments illustrated, but by the appended claims and their legal equivalents.

While the invention has been described in conjunction with preferred specific embodiments thereof, it will be understood that this description is intended to illustrate and not to limit the scope of the invention, which is defined by the following claims:

I claim:

1. A foot connected stilt assembly using a conventional bucket means as an elevating object, comprising:

a) a foot support base assembly including an attachment strap having an adjustable attachment buckle and a strap attachment hook connected to outer ends thereof;

b) an elevating object resembling a bucket having a bottom wall and an entrance opening defining a bucket's top rim;

c) said foot support base assembly mounted against said bottom wall and said strap attachment hooks mounted about said top rim of said elevating object; and d) said attachment strap tightened by said adjustable attachment buckle to securely fasten said foot support base assembly on said elevating object whereby said elevating object whereby raises the user's foot above a support surface to act as an elevating support stilt.

2. A foot connected stilt assembly as described in claim 1, wherein:

a) said foot support base assembly includes a foot depression of a size and shape to receive and support either foot of a user thereof.

3. A foot connected stilt assembly as described in claim 1, including:

a) a second attachment strap having an adjustable attachment buckle and a strap attachment hook connected to an outer end thereof; and b) said second attachment strap having its said attachment hooks mounted about said top rim of said elevating object and tightened thereagainst by said adjustable attachment buckle.

4. A foot connected stilt assembly as described in claim 3, wherein:

a) said attachment strap and said second attachment strap overlap perpendicular to each other on said foot support base assembly and are operable to place said strap attachment hooks equally spaced on said top rim of said elevating object to provide maximum stability between said foot support base assembly and said elevating object.

5. A foot connected stilt assembly as described in claim 1, including:

a toe strap and a heel strap connected to said foot support base assembly, and releasably connectable to a user's foot.

6. A foot connected stilt assembly using a conventional bucket member as an elevating object, comprising:

a) a foot support base assembly including a support base member mounted on an elevating object and having adjustable attachment straps connected to said support base member and said elevating object;

b) said elevating object includes a bottom wall with an outer support surface and an entrance top rim about an entrance opening;

c) said adjustable attachment straps having outer ends releasably anchored to said entrance top rim to secure said support base member against said outer support surface of said bottom wall; and d) means to secure said support base member to a user's foot;

whereby an economical support stilt is created from said support base member and a normally disposable bucket member.

7. A foot connected stilt assembly as described in claim 6, including:

a) a second one of said foot support base assemblies connected to another one of said elevating objects is provided to be releasably connected to another one of the user's foot to achieve said economical foot connected stilt assembly to elevate a person above and for movement on a ground support surface.

8. A foot connected stilt assembly as described in claim 6, wherein:

a) said support base member having a foot depression to receive and support either foot of a user thereof.

9. A foot connected stilt assembly as described in claim 6, wherein:

a) said means to secure includes a toe strap and a heel strap connected to said support base member and releasably connectable to the user's foot.

10. A foot connected stilt assembly as described in claim 6, wherein:

a) said support base member includes a base inner ridge mounted within a bottom edge about said bottom wall of said elevating object with restricted lateral movement.

11. A foot connected stilt assembly as described in claim 6, wherein:

a) said adjustable attachment straps having outer ends secured to respective strap attachment hooks mounted about said entrance top rim to secure said support base member against said bottom wall.

12. A foot connected stilt assembly as described in claim 8, wherein:

a) said foot depression includes a bottom wall with a non-skid texturing surface to assist in resisting lateral movement of the user's foot therein.

13. A foot connected stilt assembly in combination with a pair of disposable elevating objects to create economical elevating support stilts, comprising:

a) a foot support base assembly having a support base member releasably connected by a connector means to respective ones of a pair of elevating objects;

b) said elevating object is a container having a bottom wall and an entrance top rim; and c) said connector means having an attachment strap assembly connected to said support base member and releasably connected by strap attachment members to said entrance top rim;

whereby said elevating object resembles a bucket member selected from disposable material containers of various widths and heights.

14. A foot connected stilt assembly as described in claim 13, wherein:

a) said elevating object of variable height being increased in height by use of telescoping ones of said elevating object; and b) lateral stability of said elevating object increased by use of said elevating object having a larger width.

15. A foot connected stilt assembly as described in claim 13, wherein:

a) said strap attachment members of J-shape operable to surround and enclose a portion of said entrance top rim to securely anchor said support base member to said elevating object.

16. A foot connected stilt assembly as described in claim 13, wherein:

a) said attachment strap assembly includes an adjustable attachment buckle for easy attachment and release from said elevating object.

17. A foot connected stilt assembly as described in claim 13, wherein:

a) said support base member having a foot depression to receive and support either foot of a user thereof.

18. A foot connected stilt assembly as described in claim 13, wherein:

a) said foot depression includes a bottom wall with a non-skid texturing surface to assist in resisting lateral movement of the user's foot therein.

19. A foot connected stilt assembly as described in claim 13, wherein:

a) said support base member includes a base inner ridge mounted within a top rim about said bottom wall of said elevating object to restrict lateral movement of said support base member.

20. A foot connected stilt assembly as described in claim 13, wherein:

a) said support base member of a circular shape with a diameter substantially equal to a length of a user's foot; and b) said elevating object having said bottom wall and said entrance top rim of a diameter substantially equal to said diameter of said support base member;

whereby said entrance top rim provides a substantial diametrical area of contact with a ground support surface to provide lateral stability to the user of the economical elevating support stilts.

* * * * *